US008992395B2

(12) United States Patent
Orakwusi

(10) Patent No.: US 8,992,395 B2
(45) Date of Patent: Mar. 31, 2015

(54) EXERCISE BAR AND PULL-UP APPARATUS

(71) Applicant: Obidi Orakwusi, Owings Mills, MD (US)

(72) Inventor: Obidi Orakwusi, Owings Mills, MD (US)

(73) Assignee: Obidi Orakwasi, Owings Mills, MD (US)

( * ) Notice: Subject to any disclaimer, the term of this patent is extended or adjusted under 35 U.S.C. 154(b) by 26 days.

(21) Appl. No.: 13/940,108

(22) Filed: Jul. 11, 2013

(65) Prior Publication Data

US 2014/0094347 A1 Apr. 3, 2014

Related U.S. Application Data

(60) Provisional application No. 61/708,791, filed on Oct. 2, 2012.

(51) Int. Cl.

| | |
|---|---|
| ***A63B 21/00*** | (2006.01) |
| ***A63B 23/12*** | (2006.01) |
| ***A63B 21/16*** | (2006.01) |
| ***A63B 21/072*** | (2006.01) |

(52) U.S. Cl.

CPC ..... *A63B 23/1218* (2013.01); *A63B 21/1645* (2013.01); *A63B 21/0724* (2013.01); *A63B 21/1469* (2013.01); *A63B 21/1636* (2013.01); *Y10S 482/904* (2013.01)

USPC ..... 482/106; 482/904

(58) Field of Classification Search

USPC ..... 482/126, 106, 38, 24, 41, 40, 904, 35, 482/36; 182/156

See application file for complete search history.

(56) References Cited

U.S. PATENT DOCUMENTS

| | | | | |
|---|---|---|---|---|
| D197,076 | S | 12/1963 | Spackman et al. | |
| D210,469 | S | 3/1968 | Sejersen et al. | |
| 3,430,953 | A | 3/1969 | Teetor | |
| 3,915,452 | A | 10/1975 | Winblad | |
| 4,412,677 | A | 11/1983 | Viramontes | |
| 4,458,894 | A | 7/1984 | Dudley | |
| 4,529,191 | A | 7/1985 | Miller et al. | |
| 4,662,629 | A | 5/1987 | Plovie | |
| D297,957 | S | 10/1988 | Gordon, III | |
| D301,270 | S | 5/1989 | Levenston | |
| 4,844,448 | A * | 7/1989 | Niznik | 482/40 |
| 4,900,015 | A | 2/1990 | Dissinger | |
| D320,249 | S | 9/1991 | Gerard | |
| D320,636 | S | 10/1991 | Eckler | |
| D348,706 | S | 7/1994 | Harrell | |
| 5,417,628 | A * | 5/1995 | Vanderbleek | 482/40 |
| 5,776,033 | A | 7/1998 | Brown | |
| 5,871,422 | A * | 2/1999 | Elbogen | 482/40 |
| 5,957,818 | A * | 9/1999 | Betournay | 482/105 |
| D425,151 | S | 5/2000 | Landfair | |

(Continued)

FOREIGN PATENT DOCUMENTS

GB 2474452 A 4/2011

*Primary Examiner* — Jerome w Donnelly

(74) *Attorney, Agent, or Firm* — Ty Kendrick

(57) ABSTRACT

An exercise apparatus is provided including a board and a pull-up bar integrated with a detachable barbell and dumbbell. The apparatus may be used for body weight exercise, such as pull-ups, when the mount is installed in a doorway or other suitable location. The detachable barbell and dumbbell functionality may be used for free weight exercise when detached from the mount. The mount may serve as a rack for holding the detachable barbell and dumbbell functionality when not in use for free weight exercise.

20 Claims, 12 Drawing Sheets

(56) References Cited

U.S. PATENT DOCUMENTS

| | | | | |
|---|---|---|---|---|
| 6,179,748 | B1 | 1/2001 | Barr | |
| 6,508,743 | B1 | 1/2003 | Fortin | |
| 7,108,636 | B1 * | 9/2006 | Garcia | 482/40 |
| D554,209 | S | 10/2007 | Loucks | |
| 7,621,847 | B2 | 11/2009 | Lamle et al. | |
| D626,187 | S | 10/2010 | Friedman et al. | |
| D633,156 | S | 2/2011 | Caswell et al. | |
| D633,961 | S | 3/2011 | Loew et al. | |
| 8,172,726 | B1 * | 5/2012 | Leier | 482/23 |
| D667,901 | S | 9/2012 | Garcia Chavez | |
| 8,535,204 | B2 * | 9/2013 | Stacey | 482/40 |
| 2005/0250619 | A1 | 11/2005 | Daikeler et al. | |
| 2007/0161469 | A1 * | 7/2007 | Lamle et al. | 482/94 |
| 2012/0115683 | A1 | 5/2012 | Ross | |
| 2012/0115684 | A1 | 5/2012 | Nguyen | |
| 2013/0040784 | A1 | 2/2013 | Gillespie et al. | |

* cited by examiner

EXERCISE BAR AND PULL-UP APPARATUS

CROSS-REFERENCE TO RELATED APPLICATIONS

This application claims priority from U.S. Provisional Patent Application No. 61/708,791, filed on Oct. 2, 2012, which is incorporated by reference herein in its entirety.

BACKGROUND

Society is showcasing an increase in the awareness of health and fitness. An ever increasing number of people participate in physical exercise in pursuit of improved health, physical appearance, and increased longevity. Common indoor exercise may include body weight exercise, such as pull-ups, and weight resistance training, such as with free weights. Such exercise may be conducted using relatively little equipment in terms of size and cost. For example, pull-ups may be done on any convenient horizontal bar or support affixed above the head which can be grasped by a user. Numerous such pull-up devices are available, but the great majority of devices of this type provide one basic exercise, pull-ups, perhaps with a few variations in available user grip configurations. On their own, these devices do not give the user much exercise variation to effectively engage in a plurality of weight training exercises while in the convenience of their home or office.

Accordingly, the need has arisen for a multipurpose home exercise device that incorporates exercises such as, pull-ups, barbell or dumbbell curls, squats, lunges, and the like in one compact device. The present application therefore appreciates that providing compact, usable exercise equipment that provides a variety of exercises, in minimal space, may be a challenging endeavor.

SUMMARY

In one embodiment, an apparatus for pull-ups and weight resistance training is provided. The apparatus may include a bar, a pair of contoured tubes, and a board.

The bar may include a first end and a second end defining a midpoint therebetween. The bar may be positioned in a substantially horizontal orientation with respect to a doorway on a first side of the doorway. The first and second ends of the bar may be located adjacent to a vertical extent of the doorway on the first side of the doorway. The bar may include a plurality of bar apertures extending vertically through the bar. At least one of the plurality of bar apertures may be adjacent to each of the first and second ends of the bar.

The board may include a first end and a second end defining a midpoint therebetween. The board may be positioned in a substantially horizontal orientation with respect to the doorway on a second side of the doorway opposite from the first side. The board may include a lower horizontal area positionable upon an upper sill of the doorway on the second side of the doorway. The board may include a vertical area positionable against a vertical wall surface above the upper sill of the doorway. The board may include a plurality of board apertures extending horizontally through the board. At least one of the plurality of board apertures may be adjacent to each of the first and second ends of the board.

Each contoured tube may include an upper section peak, an intermediate section, and a lower open peak. Each upper section peak may extend through an angled curve of about forty-five degrees towards the corresponding intermediate section. Each upper section peak may include one or more upper section peak apertures configured to accept mechanical fasteners between the board apertures and the contoured tubes. Each lower open peak may include one or more lower open peak apertures configured to accept mechanical fasteners to secure the contoured tubes to a detachable barbell. Each intermediate section may include one or more intermediate section apertures configured to accept mechanical fasteners to secure the contoured tubes to the bar. Each intermediate section may extend through an angled curve of about ninety degrees towards each corresponding lower open peak.

In another embodiment, an exercise device for pull-ups and weight resistance training is provided. The exercise device may include a first support, a pair of contoured tubes, a second support, and a detachable barbell.

The first support may include a first end and a second end defining a midpoint therebetween. The first support may be positioned in a substantially horizontal orientation with respect to a doorway on a first side of the doorway. The first and second ends of the first support may be located adjacent to a vertical extent of the doorway on the first side of the doorway. The first support may include a plurality of first support apertures extending vertically through the first support. At least one of the plurality of first support apertures may be adjacent to each of the first and second ends of the first support.

The second support may include a first end and a second end defining a midpoint therebetween. The second support may be positioned in a substantially horizontal orientation with respect to the doorway on a second side of the doorway opposite from the first side. The second support may include a lower horizontal area positionable upon an upper sill of the doorway on the second side of the doorway. The second support may include a vertical area positionable against a vertical wall surface above the upper sill of the doorway. The second support may include a plurality of second support apertures extending horizontally through the second support. At least one of the plurality of second support apertures may be adjacent to each of the first and second ends of the second support.

Each contoured tube may include an upper section peak, an intermediate section, and a lower open peak. Each upper section peak may extend through an angled curve of about forty-five degrees towards the corresponding intermediate section. Each upper section peak may include one or more upper section peak apertures configured to accept mechanical fasteners between the second support apertures and the contoured tubes. Each lower open peak may include one or more lower open peak apertures configured to accept mechanical fasteners to secure the contoured tubes to a detachable barbell. Each intermediate section may include one or more intermediate section apertures configured to accept mechanical fasteners to secure the contoured tubes to the first support. Each intermediate section may extend through an angled curve of about ninety degrees towards each corresponding lower open peak.

The detachable barbell may include at least two protruding barbell members affixed to and extending from the detachable barbell at either side of the midpoint of the detachable barbell. The detachable barbell may include a first angled contoured end and a second angled contoured end. The first and second angled contoured ends may include horizontally affixed members. The horizontally affixed members may include a protruding end member vertically affixed beneath the horizontally affixed members. The protruding end member may include a plurality of apertures configured to accept mechanical fasteners to secure the detachable barbell to the contoured tubes. The detachable barbell may be positioned to have a midpoint in a common vertical plane with the midpoint of the second support.

In an embodiment, a kit for pull-ups and weight resistance training is provided. The kit may include the apparatus or the exercise device as described herein. For example, the exercise device may include a first support, a pair of contoured tubes, a second support, and a detachable barbell.

In the kit, the first support may include a first end and a second end defining a midpoint therebetween. The first support may be positioned in a substantially horizontal orientation with respect to a doorway on a first side of the doorway. The first and second ends of the first support may be located adjacent to a vertical extent of the doorway on the first side of the doorway. The first support may include a plurality of first support apertures extending vertically through the first support. At least one of the plurality of first support apertures may be adjacent to each of the first and second ends of the first support.

In the kit, the second support may include a first end and a second end defining a midpoint therebetween. The second support may be positioned in a substantially horizontal orientation with respect to the doorway on a second side of the doorway opposite from the first side. The second support may include a lower horizontal area positionable upon an upper sill of the doorway on the second side of the doorway. The second support may include a vertical area positionable against a vertical wall surface above the upper sill of the doorway. The second support may include a plurality of second support apertures extending horizontally through the second support. At least one of the plurality of second support apertures may be adjacent to each of the first and second ends of the second support.

In the kit, each contoured tube may include an upper section peak, an intermediate section, and a lower open peak. Each upper section peak may extend through an angled curve of about forty-five degrees towards the corresponding intermediate section. Each upper section peak may include one or more upper section peak apertures configured to accept mechanical fasteners between the second support apertures and the contoured tubes. Each lower open peak may include one or more lower open peak apertures configured to accept mechanical fasteners to secure the contoured tubes to a detachable barbell. Each intermediate section may include one or more intermediate section apertures configured to accept mechanical fasteners to secure the contoured tubes to the first support. Each intermediate section may extend through an angled curve of about ninety degrees towards each corresponding lower open peak.

In the kit, the detachable barbell may include at least two protruding barbell members affixed to and extending from the detachable barbell at either side of the midpoint of the detachable barbell. The detachable barbell may include a first angled contoured end and a second angled contoured end. The first and second angled contoured ends may include horizontally affixed members. The horizontally affixed members may include a protruding end member vertically affixed beneath the horizontally affixed members. The protruding end member may include a plurality of apertures configured to accept mechanical fasteners to secure the detachable barbell to the contoured tubes. The detachable barbell may be positioned to have a midpoint in a common vertical plane with the midpoint of the second support.

The kit may include the mechanical fasteners. The mechanical fasteners may include one or more of a bolt, a nut, a pin, a screw, a nail, a clamp, or a quick-release fastener.

The kit may include instructions. The instructions may direct a user to perform one or more of: install the exercise device in the doorway; grip the bar to perform a pull-up or chin-up exercise; detach the detachable barbell from the contoured tubes using the mechanical fasteners; attach the detachable barbell to the contoured tubes using the mechanical fasteners; grip the detachable barbell in a detached condition to perform a barbell exercise; and position one or more weight plates onto the detachable barbell.

BRIEF DESCRIPTION OF THE DRAWINGS

The accompanying figures, which are incorporated in and constitute a part of the specification, illustrate example methods and apparatuses, and are used merely to illustrate example embodiments.

DETAILED DESCRIPTION

This document describes home exercise equipment, for example, an apparatus including a board and a pull-up bar integrated with a detachable barbell and dumbbell. The apparatus may be used for body weight exercise, such as pull-ups, when the mount is installed in a doorway or other suitable location. The detachable barbell and dumbbell functionality may be used for free weight exercise when detached from the mount. The mount may serve as a rack for holding the detachable barbell and dumbbell functionality when not in use for free weight exercise.

Figure 1:
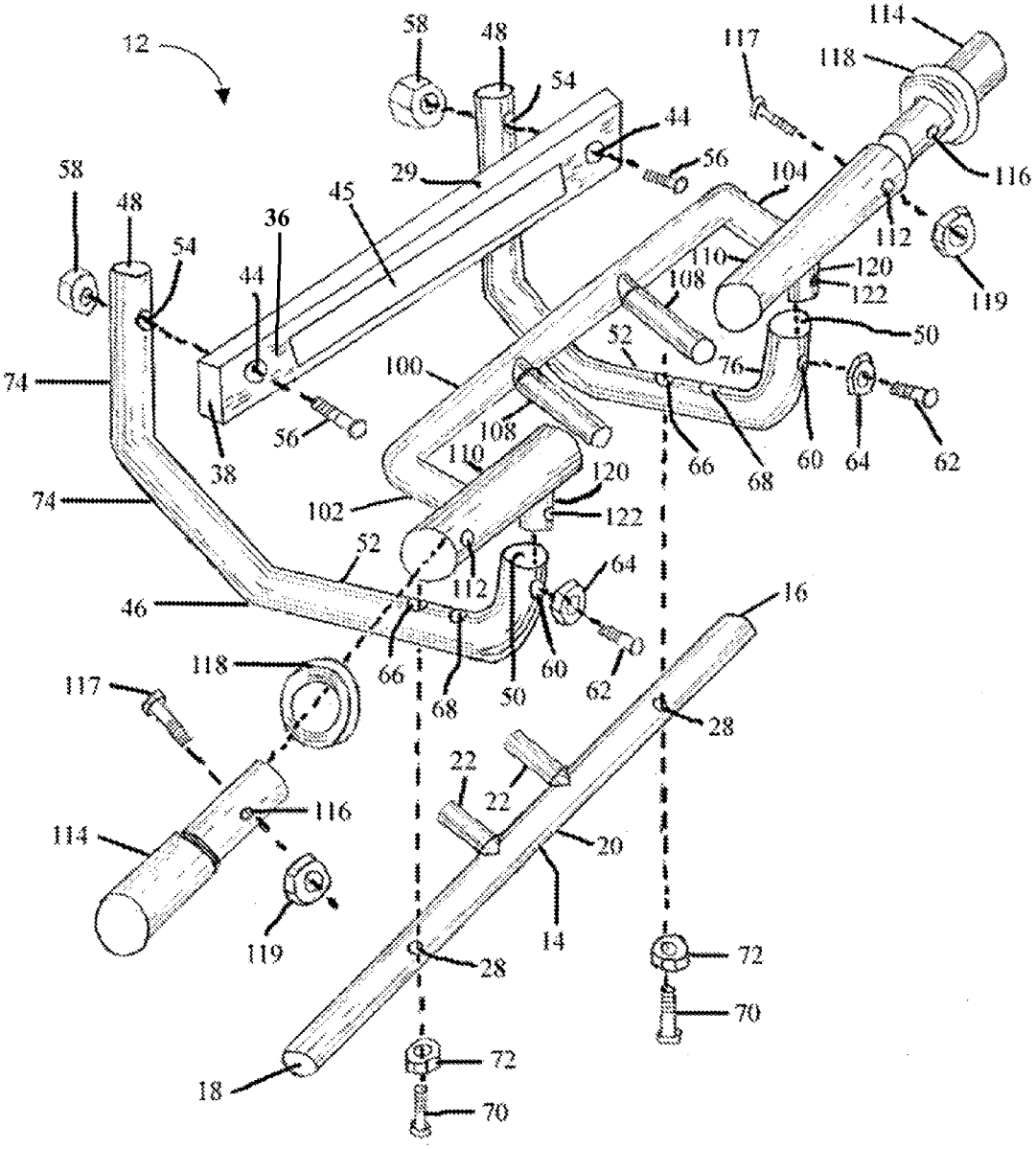
FIG. 1 is an exploded view of an example apparatus.

FIG. 1 is an exploded view of an example apparatus 12. Apparatus 12 may be an exercise device, for example, configured for pull-ups and weight resistance training as described herein. Apparatus 12 may include a bar 14. Bar 14 may be tubular in form as depicted or otherwise contoured to facilitate gripping. Bar 14 may be fabricated of a rigid metal material. Bar 14 may include a first end 16 and a second end 18. Bar 14 may include a midpoint 20 between the first end 16 and the second end 18. Bar 14 may include protruding bar members 22. Protruding bar members 22 may extend from bar 14 adjacent to the left and right of midpoint 20. Bar 14 may be positioned in a horizontal orientation for operation and use.

Figure 2:
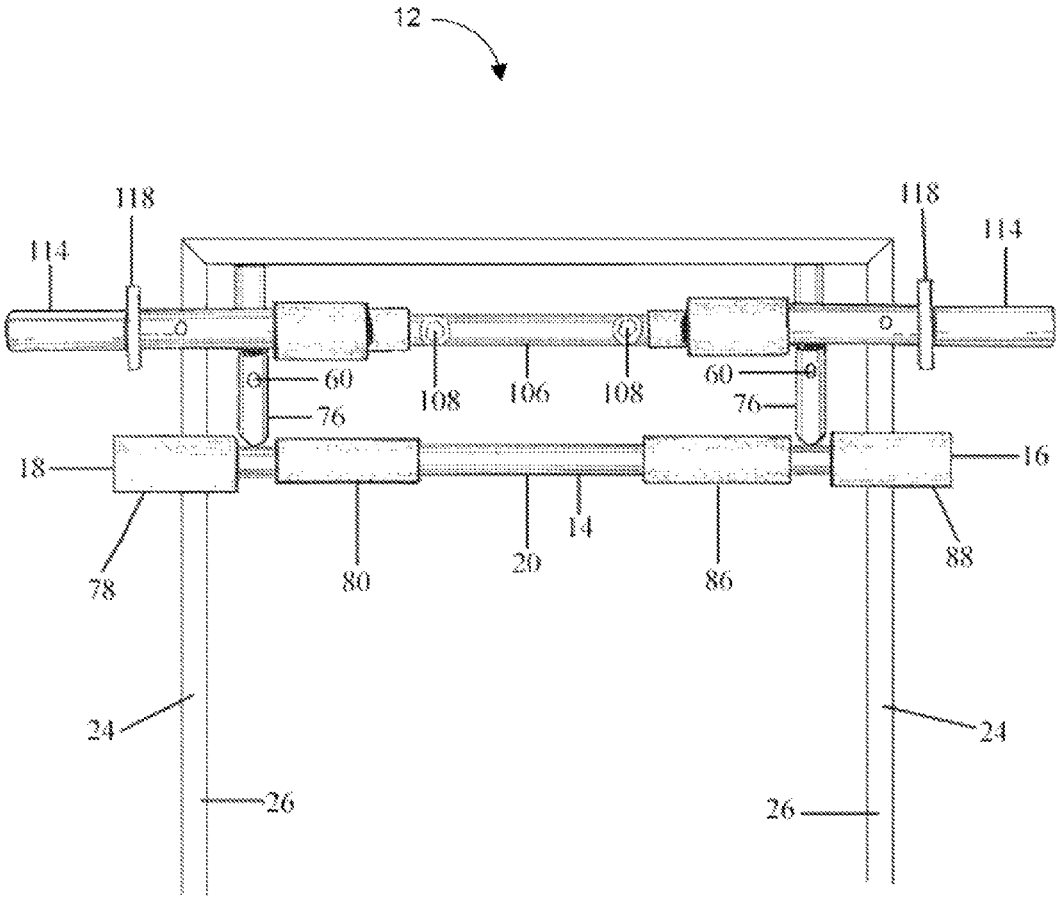
FIG. 2 is a rear elevation view of the example apparatus installed in a doorway.

FIG. 2 illustrates a rear elevation of apparatus 12 installed in a doorway 24. With reference to both FIG. 1 and FIG. 2, in the horizontal orientation, the first end 16 and the second end 18 may be located adjacent to a vertical extent of a doorway 24 on a first side 26 of doorway 24. Bar 14 may have apertures 28 adjacent to the first end 16 and the second end 18. Bar 14 may be positioned in a substantially horizontal orientation with respect to doorway 24 on first side of the doorway 26.

As used herein, directional terms such as "horizontal" and "vertical" are relative terms indicating the orientation of the mentioned element in relation to the apparatus as installed in doorway 24. For example, "vertical" refers to an element which may align with the vertical extent of doorway 24 when the apparatus may be installed in doorway 24. Also for example, "horizontal" refers to element which may align perpendicular to the vertical extent of doorway 24 when the apparatus may be installed in doorway 24.

Figure 3:
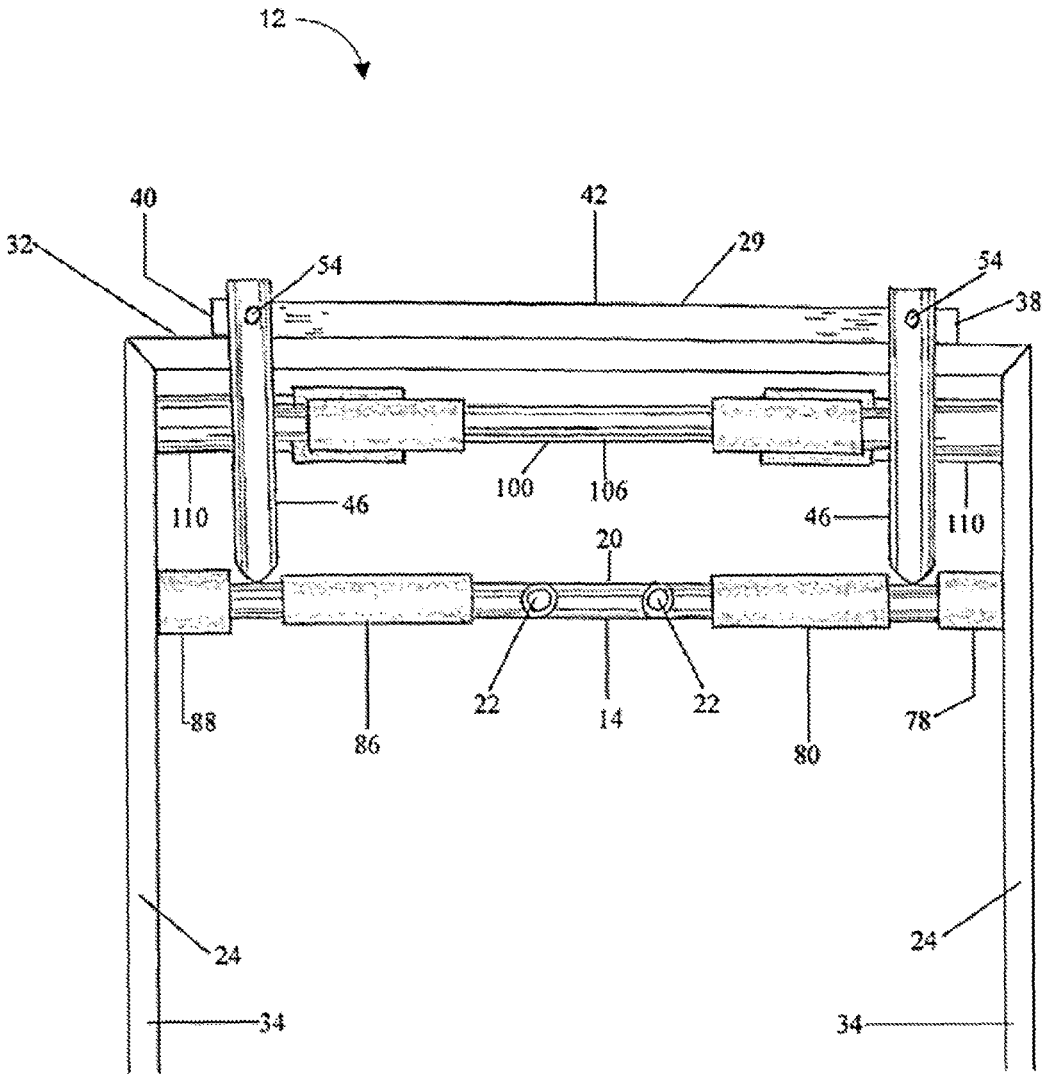
FIG. 3 is a front elevation view of the example apparatus installed in a doorway.

With further reference to FIG. 1, apparatus 12 may include a board 29, which may be made of plastic, metal, or wood, for example. Board 29 may include a rectangular cross sectional configuration as depicted. Board 29 may include a lower horizontal area 30. FIG. 3 illustrates a front elevation view of apparatus 12 installed in doorway 24. With reference to FIG. 3, lower horizontal area 30 may be positioned upon an upper sill 32 of doorway 24 on the second side 34 thereof, opposite from first side 26.

With further reference to FIG. 1 and FIG. 3, board 29 may include a vertical extent 36. Vertical extent 36 may be positioned against a vertical wall surface above the upper sill 32. Board 29 may include a first end 38, a second end 40, and a midpoint 42. Board 29 may include horizontal apertures 44 extending through the board 29 adjacent to first end 38 and second end 40. Horizontal apertures 44 may be associated with mechanical fasteners, such as nuts 58 and bolts 56. A protective strip of padding 45 may be adhered to vertical extent 36 of board 29 to preserve the wall on second side 34 of doorway 24, for example, by preventing wall discoloration and bruising. Board 29 may be less in length compared to bar 14. Bar 14 and board 29 may be coupled together to place midpoint 20 and midpoint 42 in a common vertical plane.

Apparatus 12 may include a pair of contoured tubes 46. Contoured tubes 46 may be fabricated of a rigid metal or polymer material. Each of contoured tubes 46 may include a first end upper peak 48 and a second end lower peak opening 50. Each upper peak 48 may include apertures 54 configured to accept mechanical fasteners for coupling to the board 29, for example, bolts 56 and nuts 58. Each of contoured tubes 46 may include apertures 60 adjacent to lower peak opening 50. Apertures 60 may be configured to accept mechanical fasteners for coupling to the detachable barbell 100 through the lower open peak 50 and apertures 60 of the contoured tube 46, for example, bolts 62 and nuts 64. Intermediate sections 52 of contoured tubes 46 may also include apertures 66 and 68 for coupling bar 14 via vertical apertures 28 with mechanical fasteners, for example, associated bolts 70 and nuts 72.

Each of contoured tubes 46 may include an upper vertical section 74 and a lower vertical section 76. Upper vertical section 74 may be in a vertically curved configuration forming angles of about forty-five degrees. Lower vertical section 76 may be formed in a J-shaped configuration ascending in a vertically curved angle of about ninety degrees.

Figure 4:
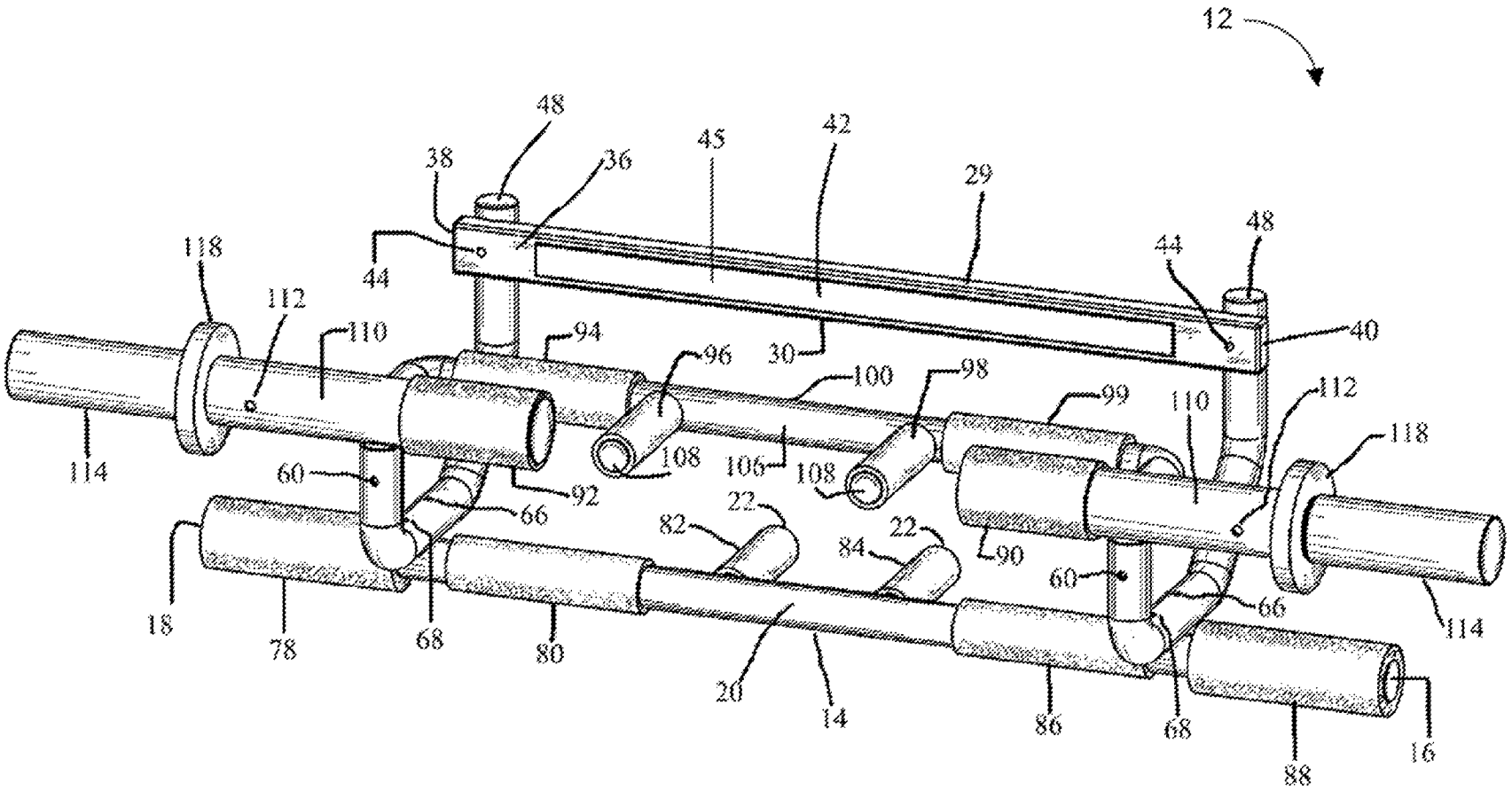
FIG. 4 is a perspective view of the example apparatus for pull-ups and weight resistance training.

FIG. 4 illustrates a perspective view of apparatus 12. Apparatus 12 may include one or more foam grips 78, 80, 82, 84, 86, and/or 88 located on bar 14. Additional foam grips 90, 92, 94, 96, 98, and/or 99 may be located on the detachable barbell 100.

With further reference to FIG. 1, apparatus 12 may include barbell 100. Barbell 100 may include a tubular bar having a first end 102, a second end 104, and a midpoint 106. First end 102 may include a contoured or curved angle as depicted. Second end 104 may include a contoured or curved angle as depicted. Barbell 100 may include protruding barbell members 108. Protruding barbell members 108 may be configured as handles or grips. Protruding barbell members 108 may be configured to extend from barbell 100 from either side of midpoint 106. Members 110 may be horizontally affixed to ends 102 and 104. Members 110 may be of a rigid metal or polymer material. Apparatus 12 may include extension tubes 114. Extension tubes 114 may be configured for use as barbell sleeves and/or dumbbell handles. Extension tubes 114 may include apertures 116 configured to accept mechanical fasteners, for example, bolts 117 and nuts 119.

Members 110 may include apertures 112 configured for coupling with extension tubes 114 via apertures 116 using such mechanical fasteners.

Extension tubes 114 may include weight plate barriers 118. A protruding extension member 120 may be vertically affixed beneath the horizontally affixed tubes 110. Protruding extension member 120 may include horizontal apertures 122 adjacent to the lower open peak 50 on the contoured tubes 46. Apertures 122 may be configured to accept mechanical fasteners for coupling with apertures 60 of contoured tubes 46. Mechanical fasteners for protruding extension member 120 may include bolts 62 and nuts 64 to secure the coupling of detachable barbell 100 to lower peak opening 50 of contoured tubes 46. Detachable barbell 100 may provide the user access to any exercise performable using free weight barbells. For example, exercises may include barbell curls, squats, lunges, triceps extension, rows, presses, cleans, deadlifts, and the like.

Various embodiments include an apparatus 12 for pull-ups and weight resistance training. Apparatus 12 may include a bar 14, a board 29, and a pair of contoured tubes 46.

Figure 5:
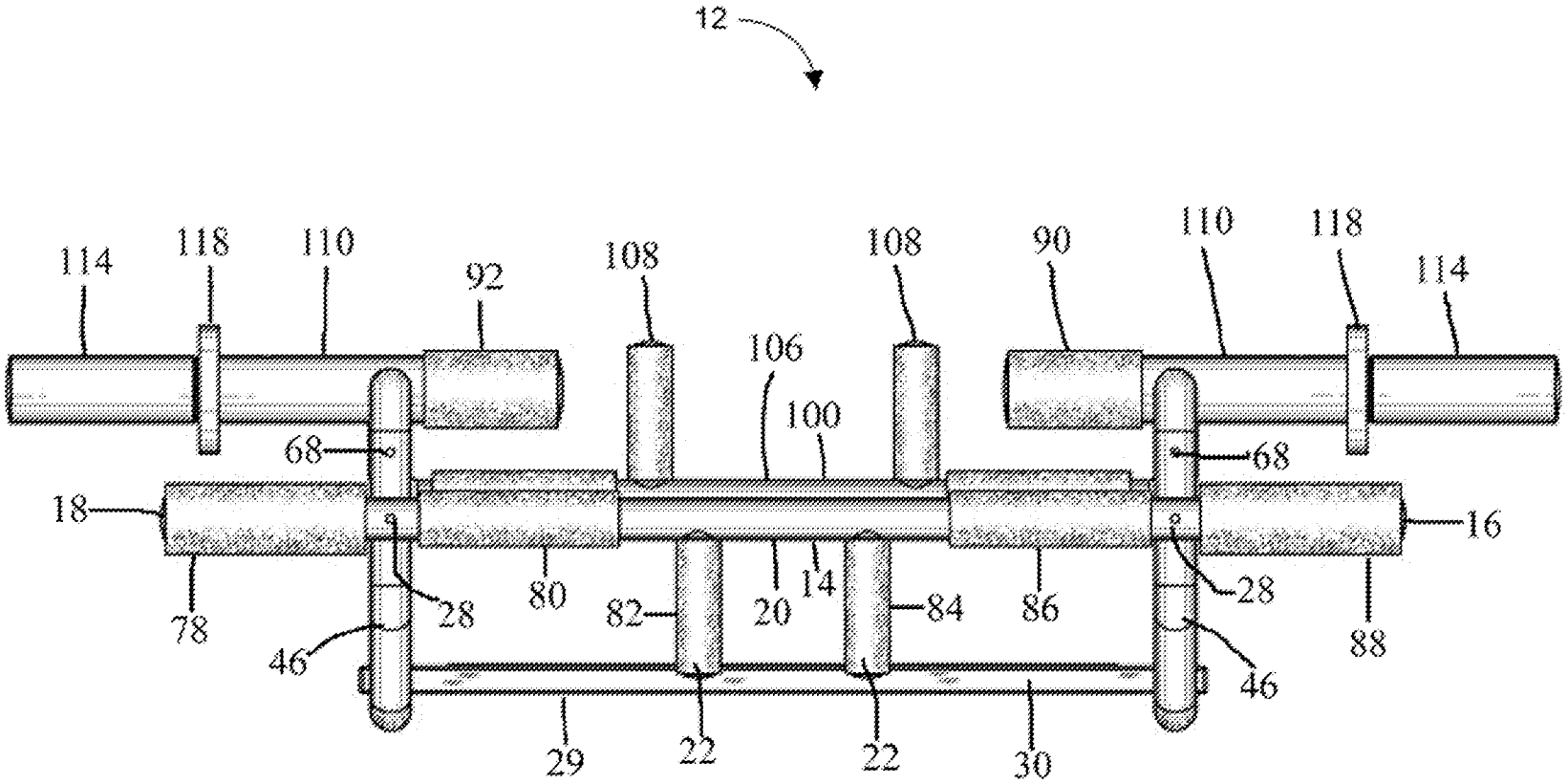
FIG. 5 is a bottom plan view of the example apparatus.

FIG. 5 is a bottom plan view of apparatus 12. Bar 14 may include a plurality of bar apertures 28 extending vertically through bar 14. At least one of plurality of bar apertures 28 may be adjacent to each of first end 16 and second end 18 of bar 14.

With further reference to FIG. 3, board 29 may include a first end 38 and a second end 40 defining a midpoint 42 therebetween. Board 29 may be positioned in a substantially horizontal orientation with respect to doorway 24 on a second side 34 of doorway 24 opposite from first side 26. Board 29 may include a lower horizontal area 30 positionable upon an upper sill 32 of doorway 24 on second side of the doorway 34. Board 29 may include a vertical area positionable against a vertical wall surface above the upper sill 32 of doorway 24. Board 29 may include a plurality of board apertures 44 extending horizontally through board 29. At least one of plurality of board apertures 44 may be adjacent to each of first end 38 and second end 40 of board 29.

With further reference to FIG. 1, each contoured tube 46 may include an upper section peak 48, an intermediate section 52, and a lower open peak 50.

Each upper section peak 48 may extend through an angled curve of about forty-five degrees towards the corresponding intermediate section 52. Each upper section peak 48 may include one or more upper section peak apertures 54 configured to accept mechanical fasteners between the board apertures 44 and the contoured tubes 46.

Each lower open peak 50 may include one or more lower open peak apertures 60. Lower open peak apertures 60 may be configured to accept mechanical fasteners to secure the contoured tubes 46 to a detachable barbell 100.

Each intermediate section 52 may include one or more intermediate section apertures 66 and 68. Intermediate section apertures 66 and 68 may be configured to accept mechanical fasteners to secure the contoured tubes 46 to the bar 14. Each intermediate section 52 may extend through an angled curve of about ninety degrees towards each corresponding lower open peak 50.

Figure 6:
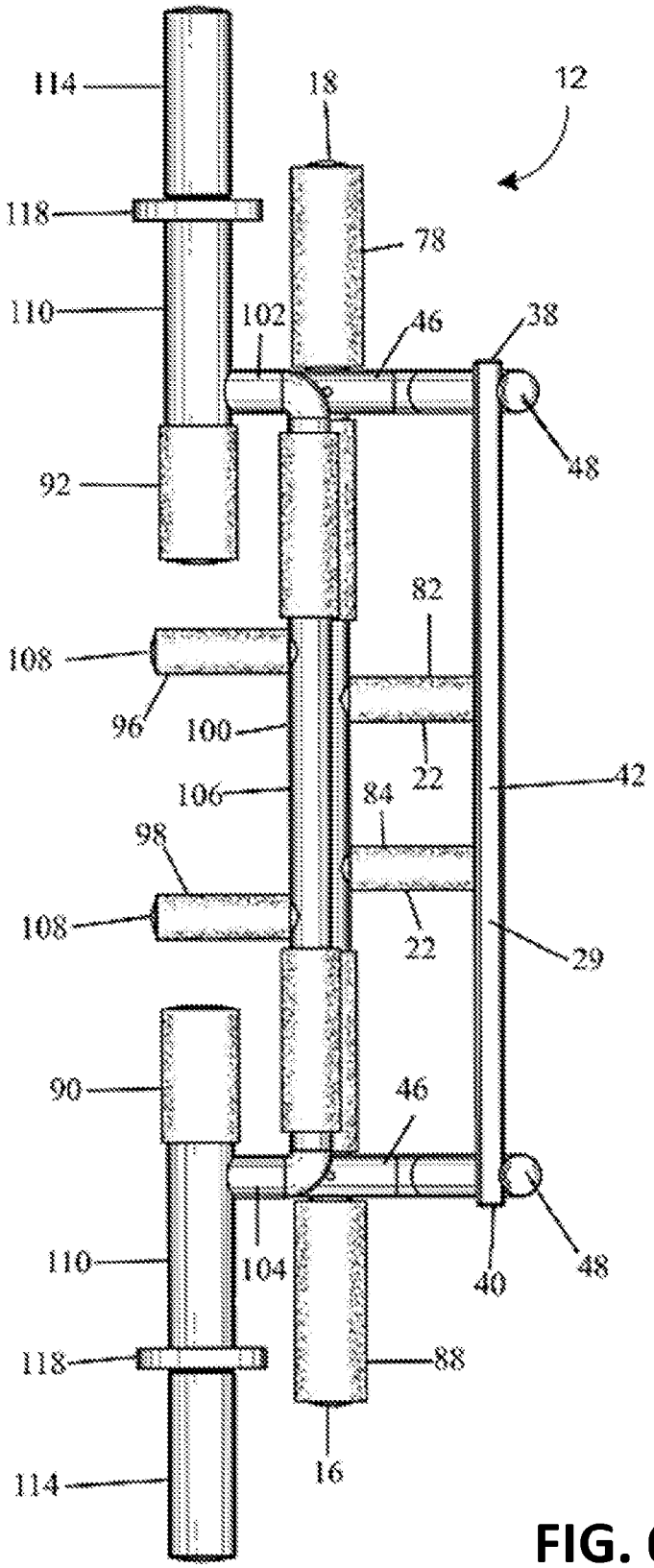
FIG. 6 is a top plan view of the example apparatus.

FIG. 6 illustrates a top plan view of apparatus 12.

Figure 7:
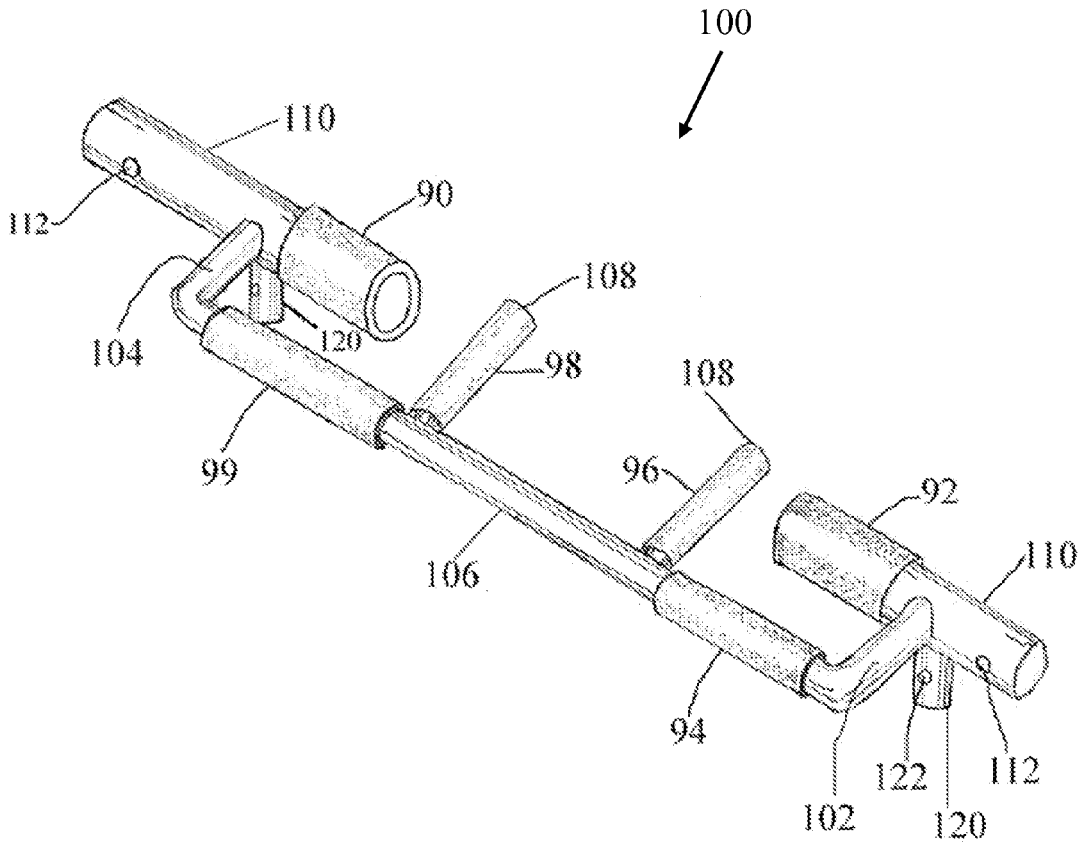
FIG. 7 is a perspective view of the detachable barbell.

FIG. 7 illustrates a perspective view of detachable barbell 100. In various embodiments, apparatus 12 may include the barbell 100. Detachable barbell 100 may include at least two protruding barbell members 108. Protruding barbell members 108 may be affixed to and may extend from the detachable barbell 100 at either side of a midpoint 106 of the detachable barbell 100.

Detachable barbell 100 may include a first angled contoured end 102 and a second angled contoured end 104. First and second angled contoured ends 102, 104 may include horizontally affixed members 110. Horizontally affixed members 110 may include a protruding end member 120 vertically affixed below horizontally affixed members 110. Protruding end member 120 may comprise a plurality of apertures configured to accept mechanical fasteners to secure the detachable barbell 100 to contoured tubes 46.

Detachable barbell 100 may be positioned to include midpoint 106 in a common vertical plane with midpoint 42 of board 29.

With further reference to FIG. 1, apparatus 12 may include two or more removable extension tubes 114 and corresponding weight plate barriers 118 of a rigid metal or polymer material. Two or more removable extension tubes 114 may be configured as barbell sleeves and/or dumbbell handles. Horizontally affixed members 110 may include apertures 112 configured to accept mechanical fasteners to secure two or more removable extension tubes 114 and corresponding weight plate barriers 118 to horizontally affixed members 110.

In some embodiments, apparatus 12 may include a rigid material as part of one or more of the bar 14, the board 29, the contoured bars 46, the removable extension tubes 114, the protruding bar members 22, protruding barbell members 108 the horizontally affixed members 110, or protruding extension members 120. The rigid material may include one or more of a metal, a plastic, a wood, or a composite or combination thereof.

In various embodiments, apparatus 12 may include a tubular form as part of one or more of the contoured bars 46, the removable extension tubes 114, protruding bar members 22, horizontally affixed members 110, or protruding end members 120.

In some embodiments, apparatus 12 may include mechanical fasteners. The mechanical fasteners including one or more of a bolt, a nut, a pin, a screw, a nail, a clamp, or a quick-release fastener.

In various embodiments, apparatus 12 may be configured as an exercise device for pull-ups and weight resistance training. The exercise device may include one or more elements or features as described herein for apparatus 12. For example, the exercise device may include a first support, a pair of contoured tubes, a second support, and a detachable barbell 100. For example, in the exercise device, bar 14 may be configured as a first support. The first support may be in any suitable form. The first support may include one or more features or elements as described for bar 14. In the exercise device, board 29 may be configured as a second support. The second support may be in any suitable form. The second support may include one or more features or elements as described for board 29.

In the exercise device, the first support may include a first end 16 and a second end 18 defining a midpoint 20 therebetween. With reference to FIG. 2, the first support may be positioned in a substantially horizontal orientation with respect to a doorway 24 on a first side of the doorway 26. First end 16 and second end 18 may be located adjacent to a vertical extent of doorway 24 on first side of the doorway 26.

In the exercise device, the first support may include a plurality of first support apertures 28 extending vertically through the first support. At least one of plurality of first support apertures 28 may be adjacent to each of first end 16 and second end 18 of the first support.

In the exercise device, the second support may include a first end 38 and a second end 40 defining a midpoint 42 therebetween. With reference to FIG. 3, the second support may be positioned in a substantially horizontal orientation with respect to doorway 24 on a second side 34 of doorway 24 opposite from first side 26.

In the exercise device, the second support may include a lower horizontal area 30 positionable upon an upper sill 32 of doorway 24 on second side of the doorway 34. The second support may include a vertical area positionable against a vertical wall surface above the upper sill 32 of doorway 24. The second support may include a plurality of second support apertures 44 extending horizontally through the second support. At least one of plurality of the second support apertures 44 may be adjacent to each of first end 38 and second end 40 of the second support.

In the exercise device, each contoured tube 46 may include an upper section peak 48, an intermediate section 52, and a lower open peak 50.

In the exercise device, each upper section peak 48 may extend through an angled curve of about forty-five degrees towards the corresponding intermediate section 52. Each upper section peak 48 may include one or more upper section peak apertures 54 configured to accept mechanical fasteners between the second support apertures 44 and the contoured tubes 46.

In the exercise device, each lower open peak 50 may include one or more lower open peak apertures 60. Lower open peak apertures 60 may be configured to accept mechanical fasteners to secure the contoured tubes 46 to a detachable barbell 100.

In the exercise device, each intermediate section 52 may include one or more intermediate section apertures 66 and 68. Intermediate section apertures 66 and 68 may be configured to accept mechanical fasteners to secure the contoured tubes 46 to the first support. Each intermediate section 52 may extend through an angled curve of about ninety degrees towards each corresponding lower open peak 50.

In the exercise device, detachable barbell 100 may include at least two protruding barbell members 108. Protruding barbell members 108 may be affixed to and may extend from the detachable barbell 100 at either side of a midpoint 106 of the detachable barbell 100. Detachable barbell 100 may include a first angled contoured end 102 and a second angled contoured end 104. First and second angled contoured ends 102, 104 may include horizontally affixed members 110. Horizontally affixed members 110 may include a protruding end member 120 vertically affixed below horizontally affixed members 110 and comprising a plurality of apertures configured to accept mechanical fasteners to secure the detachable barbell 100 to contoured tubes 46. Detachable barbell 100 may be positioned to include midpoint 106 in a common vertical plane with midpoint 42 of the second support.

Figure 8:
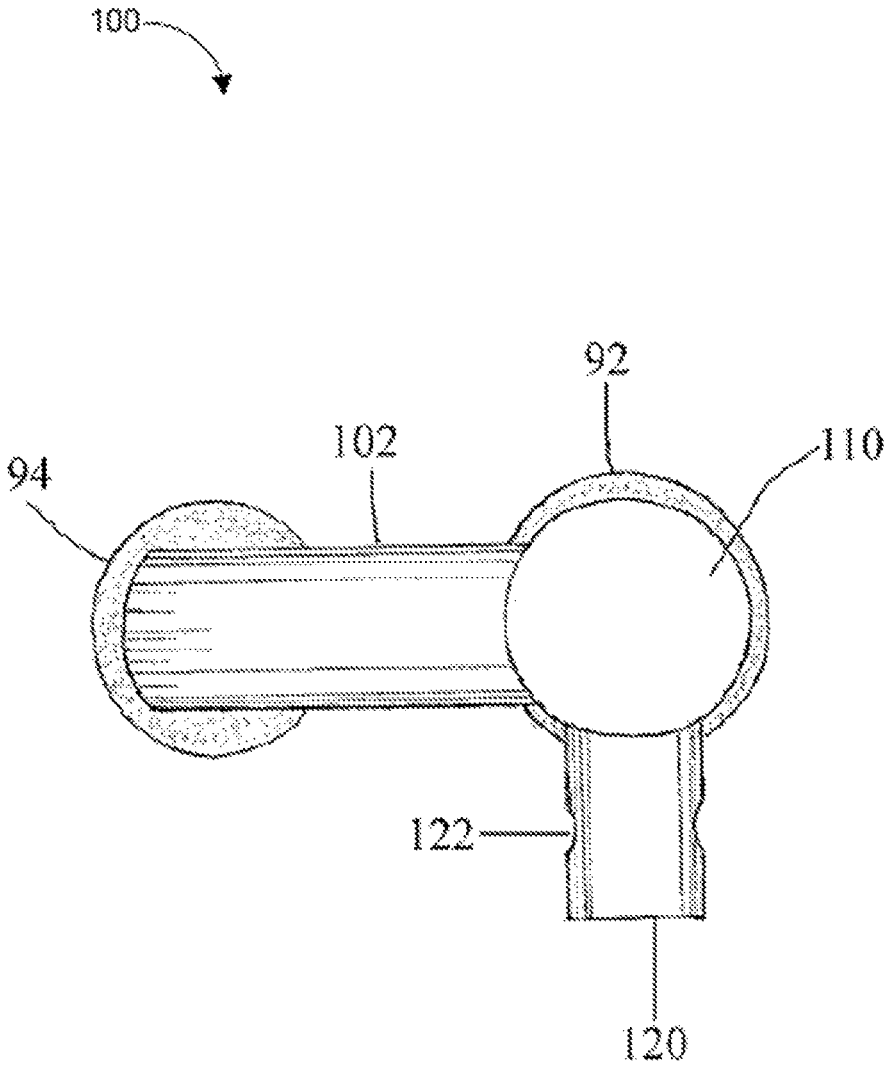
FIG. 8 is a side elevation view of a detachable barbell usable with the example apparatus.

FIG. 8 is a side elevation of detachable barbell 100 usable with apparatus 12.

Figure 9:
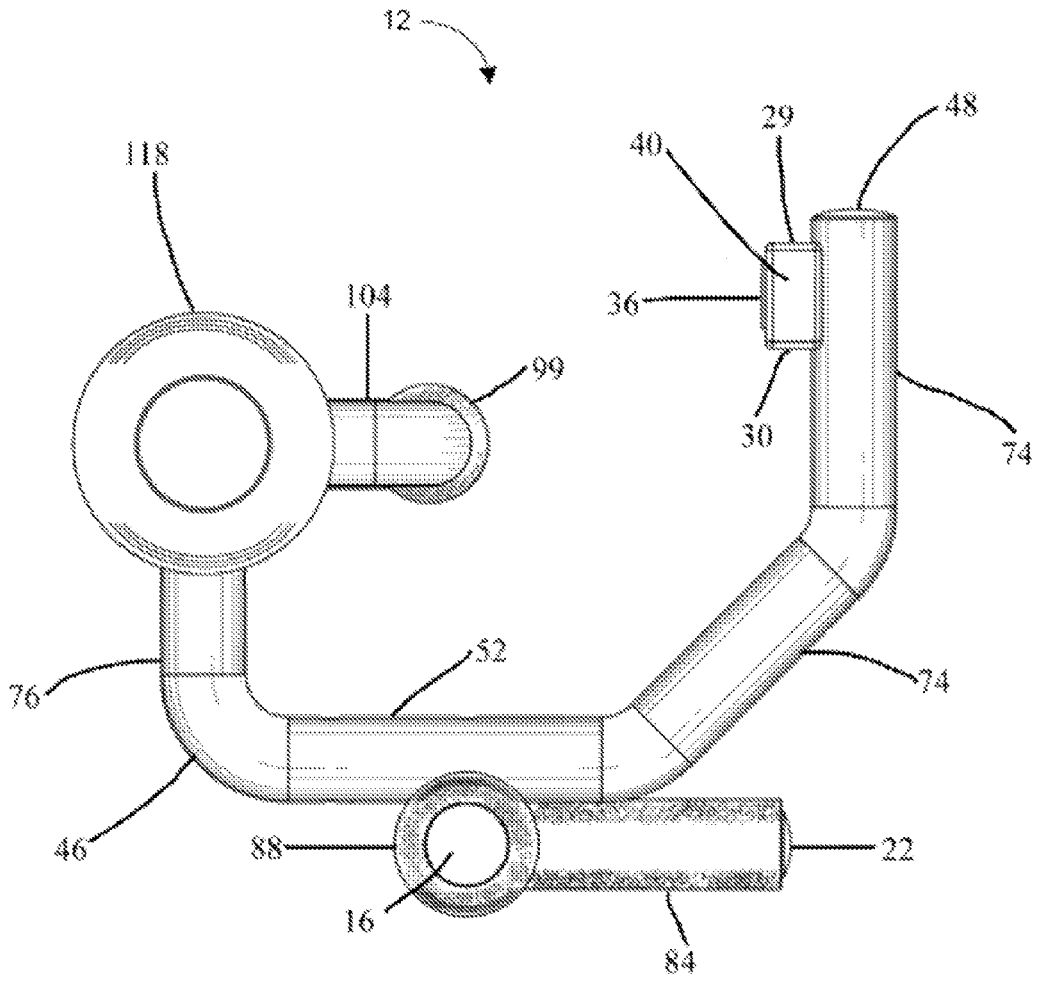
FIG. 9 is a side elevation view of the example apparatus.

FIG. 9 is a side elevation of apparatus 12.

Figure 10:
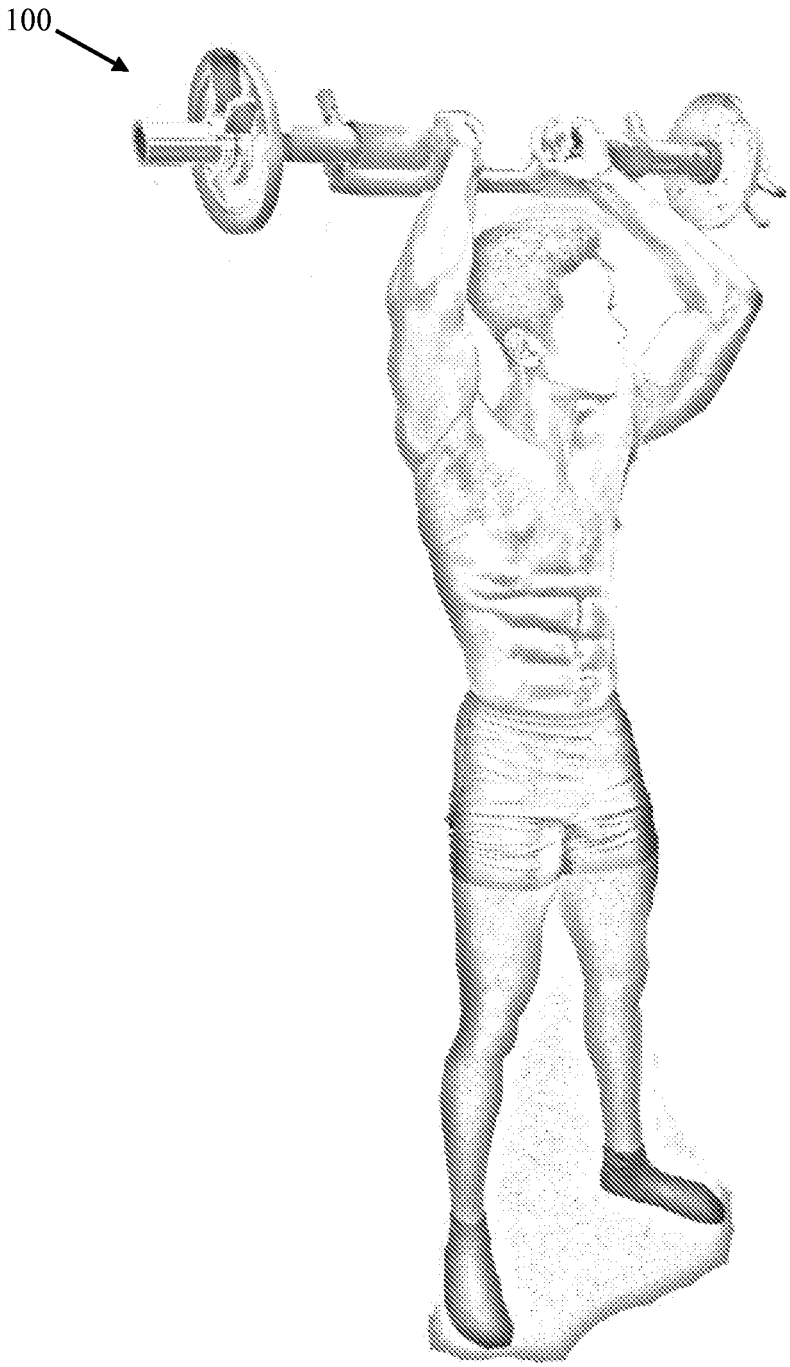
FIG. 10 is a perspective view of a user performing an exercise with the detachable barbell.

FIG. 10 is a perspective view of a user performing an exercise with detachable barbell 100.

Figure 11:
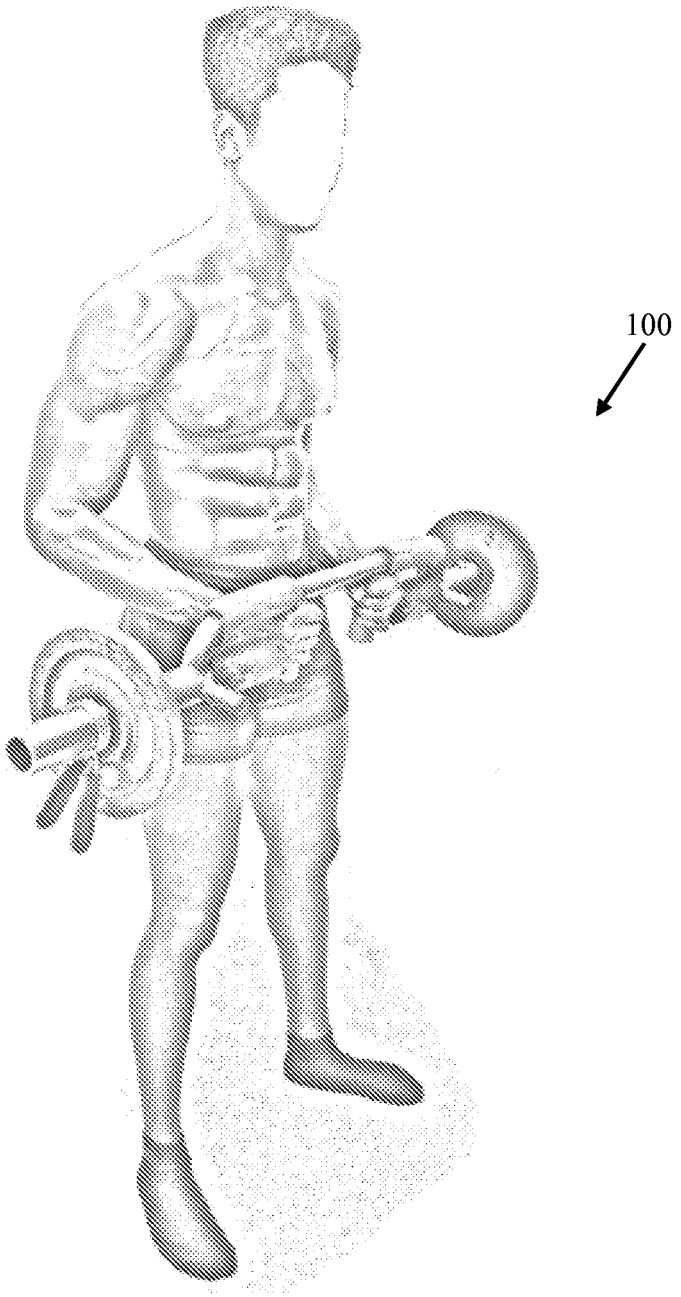
FIG. 11 is a perspective view of a user performing an exercise with the detachable barbell.

FIG. 11 is a perspective view of a user performing an exercise with detachable barbell 100.

Figure 12:
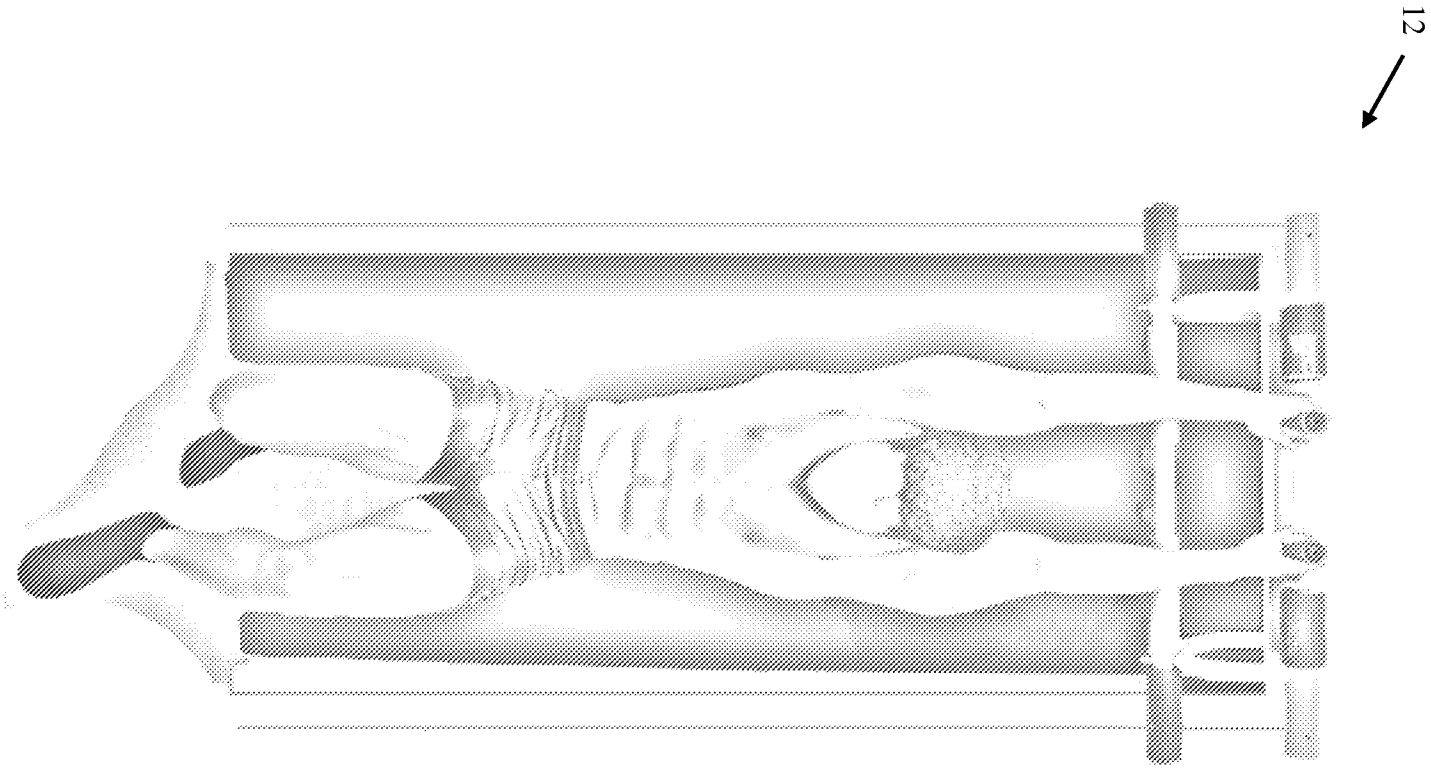
FIG. 12 is a rear elevation view of a user performing an exercise with the example apparatus.

FIG. 12 is a rear elevation view of a user performing an exercise with apparatus 12.

In various embodiments, a kit for pull-ups and weight resistance training is provided. The kit may include the apparatus 12 or the exercise device as described herein. The kit may include any feature or element of the apparatus 12 or the exercise device as described herein. For example, the exercise device of the kit may include a first support, a pair of contoured tubes, a second support, and a detachable barbell 100. For example, in the exercise device of the kit, bar 14 may be configured as a first support. The first support may be in any suitable form. The first support may include one or more features or elements as described for bar 14. In the exercise device of the kit, board 29 may be configured as a second support. The second support may be in any suitable form. The second support may include one or more features or elements as described for board 29.

In the exercise device of the kit, the first support may include a first end 16 and a second end 18 defining a midpoint 20 therebetween. The first support may be positioned in a substantially horizontal orientation with respect to a doorway 24 on a first side of the doorway 26. First end 16 and second end 18 may be located adjacent to a vertical extent of doorway 24 on first side of the doorway 26.

In the exercise device of the kit, the first support may include a plurality of first support apertures 28 extending vertically through the first support. At least one of plurality of first support apertures 28 may be adjacent to each of first end 16 and second end 18 of the first support.

In the exercise device of the kit, the second support may include a first end 38 and a second end 40 defining a midpoint 42 therebetween. The second support may be positioned in a substantially horizontal orientation with respect to doorway 24 on a second side 34 of doorway 24 opposite from first side 26.

In the exercise device of the kit, the second support may include a lower horizontal area 30 positionable upon an upper sill 32 of doorway 24 on second side of the doorway 34. The second support may include a vertical area positionable against a vertical wall surface above the upper sill 32 of doorway 24. The second support may include a plurality of second support apertures 44 extending horizontally through the second support. At least one of plurality of the second support apertures 44 may be adjacent to each of first end 38 and second end 40 of the second support.

In the exercise device of the kit, each contoured tube 46 may include an upper section peak 48, an intermediate section 52, and a lower open peak 50.

In the exercise device of the kit, each upper section peak 48 may extend through an angled curve of about forty-five degrees towards the corresponding intermediate section 52. Each upper section peak 48 may include one or more upper section peak apertures 54 configured to accept mechanical fasteners between the second support apertures 44 and the contoured tubes 46.

In the exercise device of the kit, each lower open peak 50 may include one or more lower open peak apertures 60. Lower open peak apertures 60 may be configured to accept mechanical fasteners to secure the contoured tubes 46 to a detachable barbell 100.

In the exercise device of the kit, each intermediate section 52 may include one or more intermediate section apertures 66 and 68. Intermediate section apertures 66 and 68 may be configured to accept mechanical fasteners to secure the contoured tubes 46 to the first support. Each intermediate section 52 may extend through an angled curve of about ninety degrees towards each corresponding lower open peak 50.

In the exercise device of the kit, detachable barbell 100 may include at least two protruding barbell members 108. Protruding barbell members 108 may be affixed to and may extend from the detachable barbell 100 at either side of a midpoint 106 of the detachable barbell 100. Detachable barbell 100 may include a first angled contoured end 102 and a second angled contoured end 104. First and second angled contoured ends 102, 104 may include horizontally affixed members 110. Horizontally affixed members 110 may include a protruding end member 120 vertically affixed below horizontally affixed members 110, comprising a plurality of apertures configured to accept mechanical fasteners to secure the detachable barbell 100 to contoured tubes 46. Detachable barbell 100 may be positionable to include midpoint 106 in a common vertical plane with midpoint 42 of the second support. The kit may include the one or more weight plates and one or more barbell clamps configured to clamp the one or more weight plates to the detachable barbell.

The kit may include instructions in text, picture, audio, video, internet hyperlink, or combinations thereof. The instructions may include one or more of: instructions to install the exercise device in the doorway; instructions to grip the bar to perform a pull-up or chin-up exercise; instructions to detach the detachable barbell from the contoured tubes using the mechanical fasteners; instructions to attach the detachable barbell to the contoured tubes using the mechanical fasteners; instructions to grip the detachable barbell in a detached condition to perform a barbell and/or dumbbell exercise; and instructions to position one or more weight plates onto the detachable barbell.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See Bryan A. Garner, A Dictionary of Modern Legal Usage 624 (2d. Ed. 1995). Also, to the extent that the terms "in" or "into" are used in the specification or the claims, it is intended to additionally mean "on" or "onto." To the extent that the term "substantially" is used in the specification or the claims, it is intended to take into consideration the degree of precision available or prudent in manufacturing. To the extent that the term "selectively" is used in the specification or the claims, it is intended to refer to a condition of a component wherein a user of the apparatus may activate or deactivate the feature or function of the component as is necessary or desired in use of the apparatus. To the extent that the term "operatively connected" is used in the specification or the claims, it is intended to mean that the identified components are connected in a way to perform a designated function. As used in the specification and the claims, the singular forms "a," "an," and "the" include the plural. Finally, where the term "about" is used in conjunction with a number, it is intended to include±10% of the number. In other words, "about 10" may mean from 9 to 11.

As stated above, while the present application has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art, having the benefit of the present application. Therefore, the application, in its broader aspects, is not limited to the specific details, illustrative examples shown, or any apparatus referred to. Departures may be made from such details, examples, and apparatuses without departing from the spirit or scope of the general inventive concept.

The invention claimed is:

1. An apparatus for pull-ups and weight resistance training, comprising:

a bar, comprising:

a first end and a second end defining a midpoint therebetween, the bar being positionable in a substantially horizontal orientation with respect to a doorway on a first side of the doorway, the first end and the second end being located adjacent to a vertical extent of the doorway on the first side of the doorway; and a plurality of bar apertures extending vertically through the bar, at least one of the plurality of bar apertures adjacent to each of the first end and the second end of the bar;

a board, comprising:

a first end and a second end defining a midpoint therebetween, the board being positionable in a substantially horizontal orientation with respect to the doorway on a second side of the doorway opposite from the first side;

a lower horizontal area positionable upon an upper sill of the doorway on the second side of the doorway;

a vertical area positionable against a vertical wall surface above the upper sill of the doorway; and a plurality of board apertures extending horizontally through the board, at least one of the plurality of board apertures adjacent to each of the first end and the second end of the board;

a pair of contoured tubes, each contoured tube comprising:

an upper section peak, an intermediate section, and a lower open peak:

each upper section peak extending through an angled curve of about forty-five degrees towards the corresponding intermediate section and each upper section peak comprising one or more upper section peak apertures configured to accept mechanical fasteners between the board apertures and the contoured tubes;

each lower open peak comprising one or more lower open peak apertures configured to accept mechanical fasteners to secure the contoured tubes to a detachable barbell;

each intermediate section comprising one or more intermediate section apertures configured to accept mechanical fasteners to secure the contoured tubes to the bar and each intermediate section extending through an angled curve of about ninety degrees towards each corresponding lower open peak.

2. The apparatus of claim 1, further comprising the detachable barbell, the detachable barbell comprising:

at least two protruding barbell members affixed to and extending from the detachable barbell at either side of the midpoint of the detachable barbell; and a first angled contoured end and a second angled contoured end, the first angled contoured end and second angled contoured end comprising horizontally affixed members, the horizontally affixed members including a protruding end member vertically affixed beneath the horizontally affixed members, the protruding end member comprising a plurality of apertures configured to accept mechanical fasteners to secure the detachable barbell to the contoured tubes, wherein the detachable barbell is positionable to have a midpoint in a common vertical plane with the midpoint of the board.

3. The apparatus of claim 1, further comprising one or more foam grips.

4. The apparatus of claim 1, further comprising two or more removable extension tubes and corresponding weight plate barriers of a rigid material, the two or more removable extension tubes configured as barbell sleeves and/or dumbbell handles, the horizontally affixed members comprising apertures configured to accept mechanical fasteners to secure the two or more removable extension tubes and corresponding weight plate barriers to the horizontally affixed members.

5. The apparatus of claim 1, further comprising a rigid material as part of one or more of the bar, the board, the contoured bars, the removable extension tubes, the protruding members, the horizontally affixed members, or the protruding members.

6. The apparatus of claim 5, the rigid material comprising one or more of a metal, a plastic, a wood, or a composite or combination thereof.

7. The apparatus of claim 1, further comprising a tubular form as part of one or more of the contoured bars, the removable extension tubes, the protruding members, the horizontally affixed members, or the protruding members.

8. The apparatus of claim 1, the bar further comprising a plurality of protruding bar members affixed to the bar and extending therefrom, the plurality of protruding bar members being distributed to the left and right of the midpoint of the bar.

9. The apparatus of claim 1, the length of the board being less than the bar with the midpoints in a common vertical plane.

10. The apparatus of claim 1, the board comprising a rectangular cross section.

11. The apparatus of claim 1, the board comprising a pad configured to protect the vertical wall surface.

12. The apparatus of claim 1, further comprising the mechanical fasteners.

13. The apparatus of claim 12, the mechanical fasteners including one or more of a bolt, a nut, a pin, a screw, a nail, a clamp, or a quick-release fastener.

14. An exercise device for pull-ups and weight resistance training, comprising:

a first support of a rigid material, comprising:

a first end and a second end defining a midpoint therebetween, the first support being positionable in a substantially horizontal orientation with respect to a doorway on a first side of the doorway, the first end and the second end being located adjacent to a vertical extent of the doorway on the first side of the doorway; and a plurality of first support apertures extending vertically through the first support, at least one of the plurality of first support apertures adjacent to each of the first end and the second end of the first support;

a plurality of protruding rigid members affixed to the first support and extending therefrom, the plurality of protruding rigid members being distributed to the left and right of the midpoint of the first support;

a second support of a rigid material, comprising:

a first end and a second end defining a midpoint therebetween, the second support being positionable in a substantially horizontal orientation with respect to the doorway on a second side of the doorway opposite from the first side;

a lower horizontal area positionable upon an upper sill of the doorway on the second side of the doorway;

a vertical area positionable against a vertical wall surface above the upper sill of the doorway; and a plurality of second support apertures extending horizontally through the second support, at least one of the plurality of second support apertures adjacent to each of the first end and the second end of the second support;

a pair of contoured tubes of a rigid material, each contoured tube comprising:

an upper section peak, an intermediate section, and a lower open peak:

each upper section peak extending through an angled curve of about forty-five degrees towards the corresponding intermediate section and each upper section peak comprising one or more upper section peak apertures configured to accept mechanical fasteners between the second support apertures and the contoured tubes;

each lower open peak comprising one or more lower open peak apertures configured to accept mechanical fasteners to secure the contoured tubes to a detachable barbell;

each intermediate section comprising one or more intermediate section apertures configured to accept mechanical fasteners to secure the contoured tubes to the first support and each intermediate section extending through an angled curve of about ninety degrees towards each corresponding lower open peak;

the detachable barbell, the detachable barbell comprising:

at least two protruding barbell members affixed to and extending from the detachable barbell at either side of the midpoint of the detachable barbell; and a first angled contoured end and a second angled contoured end, the first angled contoured end and the second angled contoured ends comprising horizontally affixed members, the horizontally affixed members including a protruding end member vertically affixed beneath the horizontally affixed members, the protruding end member comprising a plurality of apertures configured to accept mechanical fasteners to secure the detachable barbell to the contoured tubes, wherein the detachable barbell is positionable to have a midpoint in a common vertical plane with the midpoint of the second support.

15. The exercise device of claim 14, further comprising one or more foam grips located on the first support and/or the detachable barbell.

16. The exercise device of claim 14, further comprising two or more removable extension tubes and corresponding weight plate barriers of a rigid material, the two or more removable extension tubes configured as barbell sleeves and/or dumbbell handles, the horizontally affixed members comprising apertures configured to accept mechanical fasteners to secure the two or more removable extension tubes and corresponding weight plate barriers to the horizontally affixed members.

17. The exercise device of claim 14, the second support comprising a pad configured to protect the vertical wall surface.

18. The exercise device of claim 14, further comprising the mechanical fasteners including one or more of a bolt, a nut, a pin, a screw, a nail, a clamp, or a quick-release fastener.

19. A kit for pull-ups and weight resistance training, comprising:

an exercise device for pull-ups and weight resistance training, comprising:

a bar, comprising:

a first end and a second end defining a midpoint therebetween, the bar being positionable in a substantially horizontal orientation with respect to a doorway on a first side of the doorway, the first end and the second end being located adjacent to a vertical extent of the doorway on the first side of the doorway; and a plurality of bar apertures extending vertically through the bar, at least one of the plurality of bar apertures adjacent to each of the first end and the second end of the bar;

a board, comprising:

a first end and a second end defining a midpoint therebetween, the board being positionable in a substantially horizontal orientation with respect to the doorway on a second side of the doorway opposite from the first side;

a lower horizontal area positionable upon an upper sill of the doorway on the second side of the doorway;

a vertical area positionable against a vertical wall surface above the upper sill of the doorway; and a plurality of board apertures extending horizontally through the board, at least one of the plurality of board apertures adjacent to each of the first end and the second end of the board;

a pair of contoured tubes, each contoured tube comprising:

an upper section peak, an intermediate section, and a lower open peak:

each upper section peak extending through an angled curve of about forty-five degrees towards the corresponding intermediate section and each upper section peak comprising one or more upper section peak apertures configured to accept mechanical fasteners between the board apertures and the contoured tubes;

each lower open peak comprising one or more lower open peak apertures configured to accept mechanical fasteners to secure the contoured tubes to a detachable barbell;

each intermediate section comprising one or more intermediate section apertures configured to accept mechanical fasteners to secure the contoured tubes to the bar and each intermediate section extending through an angled curve of about ninety degrees towards each corresponding lower open peak;

the detachable barbell, comprising:

at least two protruding barbell members affixed to and extending from the detachable barbell at either side of the midpoint of the detachable barbell; and a first angled contoured end and a second angled contoured end, the first angled contoured end and the second angled contoured end comprising horizontally affixed members, the horizontally affixed members including a protruding end member vertically affixed beneath the horizontally affixed members, the protruding end member comprising a plurality of apertures configured to accept mechanical fasteners to secure the detachable barbell to the contoured tubes, wherein the detachable barbell is positionable to have a midpoint in a common vertical plane with the midpoint of the board;

the mechanical fasteners, comprising one or more of a bolt, a nut, a pin, a screw, a nail, a clamp, or a quick-release fastener and instructions, comprising one or more of:

instructions to install the exercise device in the doorway;

instructions to grip the bar to perform a pull-up or chin-up exercise;

instructions to detach the detachable barbell from the contoured tubes using the mechanical fasteners;

instructions to attach the detachable barbell to the contoured tubes using the mechanical fasteners;

instructions to grip the detachable barbell in a detached condition to perform a barbell exercise; and instructions to position one or more weight plates onto the detachable barbell.

20. The kit of claim 19, further comprising the one or more weight plates and one or more barbell clamps configured to clamp the one or more weight plates to the detachable barbell.

* * * * *